United States Patent [19]

Miles et al.

[11] Patent Number: 5,058,959

[45] Date of Patent: Oct. 22, 1991

[54] IDENTIFICATION SYSTEM FOR WHEELED SUITCASES

[75] Inventors: Richard Miles, London; Ian Ferris, Surrey, both of England

[73] Assignee: Samsonite Corporation, Denver, Colo.

[21] Appl. No.: 510,383

[22] Filed: Apr. 17, 1990

[51] Int. Cl.[5] ..... B42D 15/00

[52] U.S. Cl. ..... 301/108 TW; 301/5.3; 301/37 CM; 40/6; 40/587; 40/638; 283/81

[58] Field of Search ..... 301/5.3, 37 R, 37 P, 301/37 CM, 37 TP, 37 PB, 108 R, 108 A, 108 TW; 40/6, 587, 638, 665; 283/74, 80, 81, 115

[56] References Cited

U.S. PATENT DOCUMENTS

| | | | |
|---|---|---|---|
| 2,761,229 | 9/1956 | Friedly et al. | 283/81 X |
| 3,481,652 | 12/1969 | Mazerolle | 301/37 CM |
| 3,500,364 | 3/1970 | David et al. | 40/638 X |
| 3,559,319 | 2/1971 | Scott et al. | 283/81 X |
| 4,180,284 | 12/1979 | Ashley | 40/6 X |
| 4,235,476 | 11/1980 | Arvidsson | 301/37 TP |
| 4,544,182 | 10/1985 | Spring | 283/81 |
| 4,671,003 | 6/1987 | Vitol | 40/638 |
| 4,844,509 | 7/1989 | Kasprzak et al. | 283/81 |

FOREIGN PATENT DOCUMENTS

| | | | |
|---|---|---|---|
| 0185102 | 6/1986 | European Pat. Off. | 301/108 R |
| 8607016 | 12/1986 | World Int. Prop. O. | 301/37 CM |

*Primary Examiner*—Russell D. Stormer
*Attorney, Agent, or Firm*—Gregory W. O'Connor

[57] ABSTRACT

Problems arise when a traveler must quickly identify his suitcase from an array of similar suitcases, such as on a checked luggage carousel or traveling belt. Tags and labels bearing ownership information are normally not distinctive enough to help in the split second decision to grab one's own suitcase. For cases with wheels, an identification system includes a label sized to fit within the outer periphery of the circular face of the wheel and an element for attaching the label to the face of the wheel. Preferably, the attaching system includes adhesives labels for attaching to the outer face of a hubcap on the wheel. Alternatively, the hubcap may be made transparent or may have a transparent portion, and includes releasable barbed attachments for holding the hubcap and the identifying indicia positioned between the transparent hubcap and the circular face of the wheel.

11 Claims, 2 Drawing Sheets

IDENTIFICATION SYSTEM FOR WHEELED SUITCASES

BACKGROUND OF THE INVENTION

Users of suitcases have long used tags, travel stickers, tape and other means to customize or otherwise distinguish their suitcases from others which are otherwise identical or similar. Most such identification indicia comprise the name and address of the traveler written in small letters and discretely displayed or hidden from view by the provided identification system. An example of such system is disclosed in U.S. Pat. Nos. Des. 281436, Des. 281706, and 4,828,081, assigned to the assignee of the subject invention. These systems employ a transparent window for retaining a name and address card, either attached to the frame of the luggage or contained in a discrete self-retracting pull-out envelope. U.S. Pat. No. Des. 303076, also issued to the assignee, shows a card-retaining window built into the handle structure used to support one end of the luggage piece while rolling the case on wheels provided at its opposite end. Such means of identification have been fairly successful, although such systems are not ideal for helping the user select user's case from a rapidly moving luggage belt or carousel in an airplane terminal.

Accordingly, it is an object of the subject invention to provide a clearly obvious, at least to the owner of a suitcase, identification system for distinguishing that suitcase from the same or similar suitcases. It is another object of the invention to provide a system for identifying a suitcase which does not result in marring, such as by adhesive labels or stickers, the shells of the suitcase.

BRIEF DESCRIPTION OF THE INVENTION

Accordingly, Applicant has provided a wheeled suitcase which includes at least one ground engaging wheel mounted to a shell of the case for rotation about an axis, and an improved identification system which is intended to permit the user of the suitcase to distinguish that user's suitcase from a group of otherwise identical or similar suitcases. This identification system comprises at least one identifying indicia sized to be positioned on that wheel and means for holding the indicia on the wheel. More particularly, the wheel has a circular end face co-axial with its axis of rotation, and the indicia is sized to fit within the periphery of that circular end. The indicia preferably comprises a self-adhesive label having a generally circular periphery. The wheel has a hubcap positioned on said one end face co-axial with the axis of the wheel. This hubcap can be transparent or include a transparent portion, in which case it would include a releasable attachment means for permitting the hubcap to be selectively removed and the identifying indicia or the label, sized to fit behind the transparent portion of the hubcap, is attached to the wheel by the hubcap. Alternatively, the hubcap has an outer surface which is generally flat to receive adhesive labels.

The system may comprise labels arrayed on a sheet of release paper. The labels include a series of annular die cut labels and a series of circular die cut labels sized to fit within the annular labels, whereby the user of the luggage can select a pair of labels comprising one circular and one annular label for placement on the wheel, wheelcap or hubcap of the suitcase.

DETAILED DESCRIPTION OF THE PREFERRED EMBODIMENT

Figure 1:
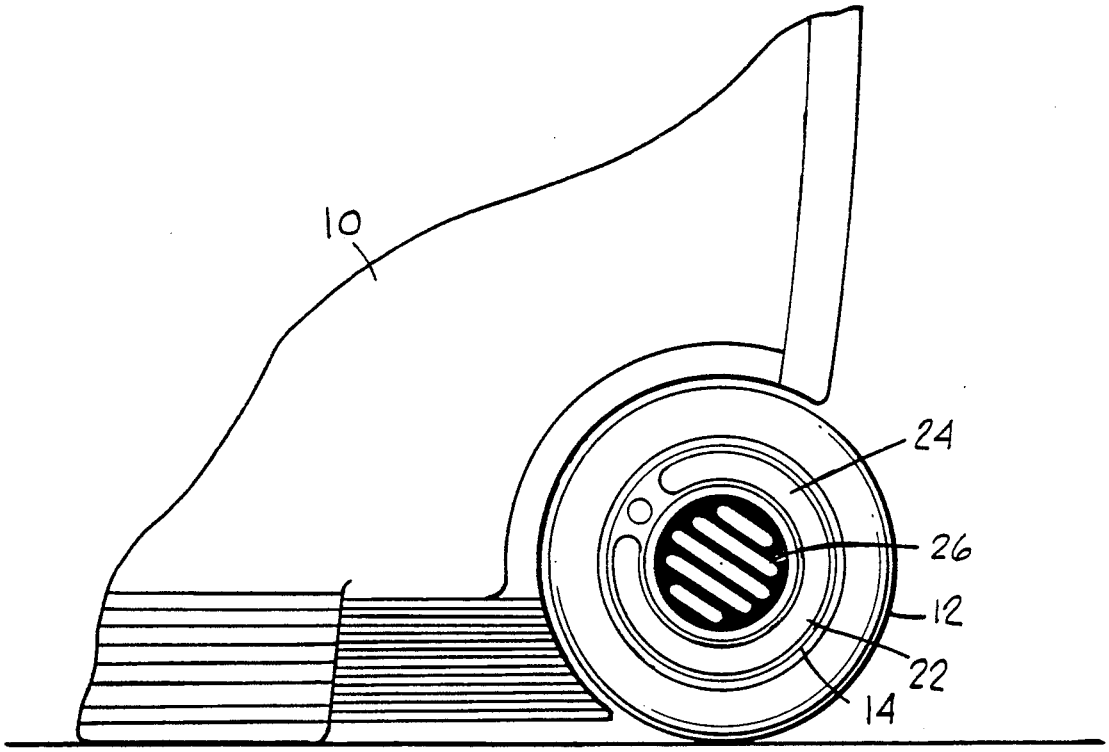
FIG. 1 shows a broken away portion of a suitcase showing the wheel mounted identification system.
Figure 2:
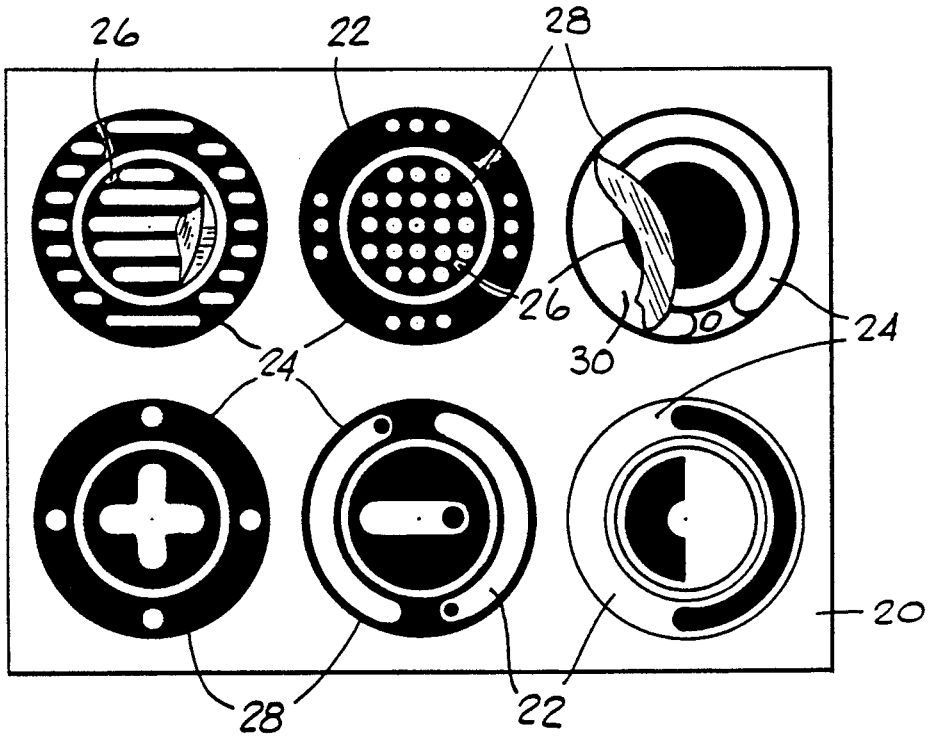
FIG. 2 shows an adhesive label sheet in accordance with the instant invention.

The suitcase 10 is of a conventional type with at least one ground engaging means located on the lower corner thereof. This ground engaging means preferably includes two wheels 12 mounted on axles 15 for rotational engagement of the horizontal surface across which the suitcase is to be rolled. The wheel includes a circular face 13 (see FIG. 3*a*), which may include a concave area which extends radially inward from the ground engaging surface of the wheel to a hub which engages the axle 15. As is typical, this face is hollowed out and may include an injection molded plastic spider which is strong and light. Fixed to the face of the wheel, preferably on a hubcap 14, is an identifying label 22. Unlike many identification systems, label 22 does not necessarily convey written information which would indicate to a stranger the name of the its owner. On the contrary, the label 22 could be an arbitrary and abstract pattern, design or indicia having its sole purpose to distinguish the suitcase 10 from other otherwise similar suitcases not having an identically patterned label. FIG. 2 shows one possible system for providing such arbitrary patterns. A sheet of adhesive labels 20 is shown. In this particular case, six basic patterns are provided. Each of the six patterns comprises two labels-an annular label 24 and a circular label 26 positioned within the center of each annular label 24. These labels are defined by the printed graphic pattern and also a pattern of die cut circles 28 which permit the labels to be lifted off of release paper 30 which supports the overall array of labels. With this array of six annular labels and six circular labels, a possible combination of at least 48 different patterns can be created. In this manner, the user can easily create a distinctive label pattern on one or both of the wheels and thus identify, at least to that user, his or her own suitcase. These labels preferably include a graphic feature which is eccentric to the wheel axis, or otherwise presents a moving pattern when that wheel rotates. In this way the distinctive indicia becomes all the more visible or obvious when the wheel is rotating.

Figure 3A:
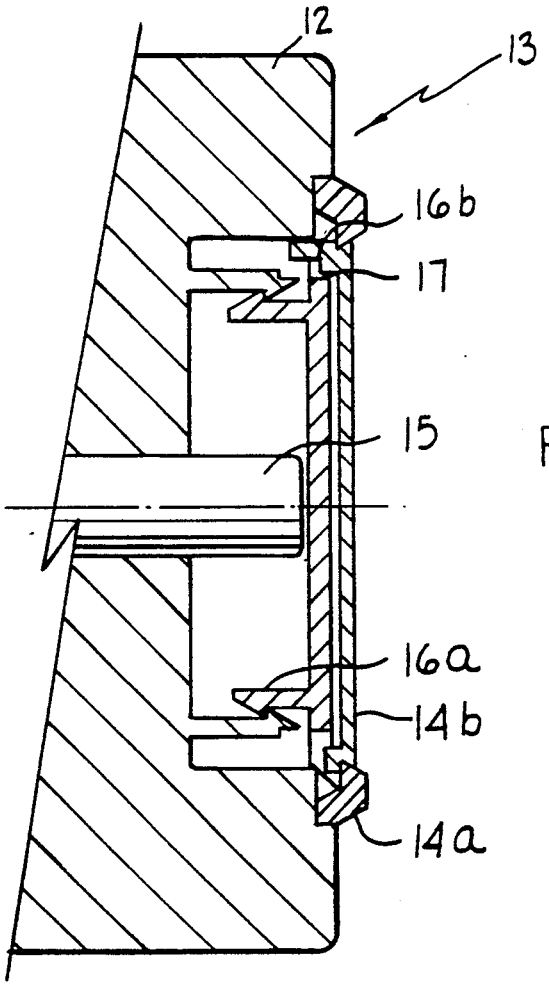
FIG. 3*a* shows an exploded view of a part of a wheel of the suitcase of FIG. 1 with FIG. 3*b* showing a part of the identification system in an exploded view.
Figure 3B:
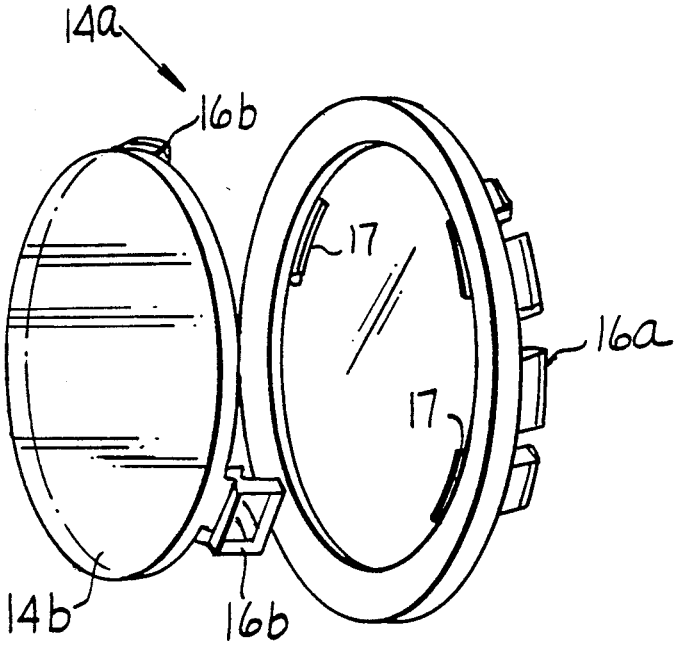

While in this simple system the labels 22 are merely adhered to the flat outer surface of hubcap 14, an alternative hubcap as shown in FIGS. 3*a* and 3*b* may be provided. Hubcap 14*a* includes at least a portion 14*b* which is transparent. Hubcap 14*a* includes integral barbed tabs 16*a* which selectively engage an inner surface of the circular face 13 of the wheel. The transparent portion 14*b* also includes projecting barbs 16*b* which engage corresponding cavities 17 in the hubcap 14*a*. In this system, the identifying label need not be adhered to the wheel, but rather may merely be sized to fit within this specially formed hubcap. Thus, the user thereof may provide his or her own identifying material which may or may not include ownership information such as name and address, and may comprise a favorite picture, a cutout portion of a magazine, etc. In this way, identifying materials need not be limited to 48 possible patterns as discussed with reference to the sheet of adhesive labels in FIG. 2. In operation, the user of the suitcase may choose to apply the identifying system of the invention to one, two or more of the wheels of the suitcase. It has been found that the rotary he movement of the wheels enhance the visibility of the chosen identifying indicia, especially if such indicia forms an pattern which is eccentric to the rotational axis of carrying wheel, or otherwise forms a moving pattern when the wheel rotates.

We claim:

1. In a wheeled suitcase, including at least one ground engaging wheel mounted to a shell of said case for rotation about an axis, an improved identification system, intended to permit the user of the suitcase to distinguish that user's case from a group of otherwise identical or similar such suitcases comprising at least one identifying indicia sized to be positioned on said wheel, and means for holding said identifying indicia on said wheel, wherein said wheel includes an end face co-axial with its axis and said identifying indicia is sized to fit within the periphery of said end face, and further comprising a sheet of labels arrayed on a sheet of release paper, said labels including a series of annular shaped labels and a series of circular shaped labels sized to fit within said annular labels, whereby a user of said luggage may select up to one circular and up to one annular label for placement on said face of said wheel.

2. An improved identification system as set forth in claim 1 wherein said labels are self adhesive.

3. An improved identification system as set forth in claim 2 wherein said wheel has a hubcap, the outer surface of said hubcap being generally flat, whereby to receive said adhesive labels thereon.

4. An improved identification system as set forth in claim 1 wherein said wheel has a hubcap positioned on said end face co-axial with said axis of said wheel.

5. An improved identification system as set forth in claim 4 wherein said hubcap includes at least a transparent portion and a releasable attachment means for permitting at least said transparent portion to be selectively removed, said label being sized to fit behind said transparent portion of said hubcap.

6. A method of marking a wheeled suitcase with identifying indicia to distinguish the suitcase from otherwise similar wheeled suitcases, the suitcase including at least one wheel with an end face which can be seen when the suitcase is in use, comprising the steps of providing identifying indicia sized to fit said end face, providing means for attaching said identifying indicia to said end face, operating said means for attaching to fasten said indicia to said end face, wherein said step of providing identifying indicia includes the step of providing a series of annular shaped labels and a series of circular shaped labels sized to fit within said annular labels, whereby a user of said luggage may select up to one circular and one annular label for placement on said face of said wheel.

7. A method as set forth in claim 6 wherein said identifying indicia includes a pattern which presents a moving pattern when the wheel to which it is attached is moved.

8. A method as set forth in claim 7 wherein said identifying indicia includes a pattern which is eccentric to the rotational axis of the wheel to which such indicia is attached, whereby the identifying function of such indicia is enhanced.

9. A method as set forth in claim 6 wherein said means for attaching includes means for adhering said indicia to an outer surface of said end face.

10. A method as set forth in claim 6 wherein said means for attaching said indicia includes a hub cap attached to said end face.

11. A method as set forth in claim 10 wherein said hub cap includes a transparent portion, and wherein said step of attaching includes placing said indicia behind said transparent portion.

* * * * *